United States Patent [19]

Vizard

[11] Patent Number: 4,467,887

[45] Date of Patent: Aug. 28, 1984

[54] EXHAUST MUFFLERS FOR INTERNAL COMBUSTION ENGINES

[75] Inventor: David Vizard, Bishops Cleeve, England

[73] Assignee: Shelburne Incorporated, Grand Terrace, Calif.

[21] Appl. No.: 326,002

[22] Filed: Nov. 30, 1981

[30] Foreign Application Priority Data

Nov. 14, 1981 [GB] United Kingdom ..... 8134369

[51] Int. Cl.[3] ..... F01H 1/08

[52] U.S. Cl. ..... 181/265; 181/268

[58] Field of Search ..... 181/265, 266, 256, 272, 181/275, 268

[56] References Cited

U.S. PATENT DOCUMENTS 2,070,543 2/1937 Cary et al. ..... 181/266

2,109,220 2/1938 Noblitt et al. ..... 181/266

4,220,219 9/1980 Flugger ..... 181/268 X

*Primary Examiner*—L. T. Hix

*Assistant Examiner*—Brian W. Brown

*Attorney, Agent, or Firm*—Young & Thompson

[57] ABSTRACT

An exhaust muffler comprises a closed chamber, an inlet pipe leading into the chamber, an outlet pipe leading from the chamber, two spaced bulkheads dividing the chamber into first and second buffer compartments separated by an intermediate compartment containing a glass fiber pack, three pass tubes extending through the bulkheads and across the intermediate compartment, two of the pass tubes forming continuations of the inlet and outlet pipes respectively and having flared open ends in the buffer compartments respectively, and a parabolic noise reflector located opposite the open end of said two pass tubes in such manner as to reflect down the pass tubes a proportion of the noise generated by gases flowing along the pass tubes.

7 Claims, 4 Drawing Figures

FIG.2
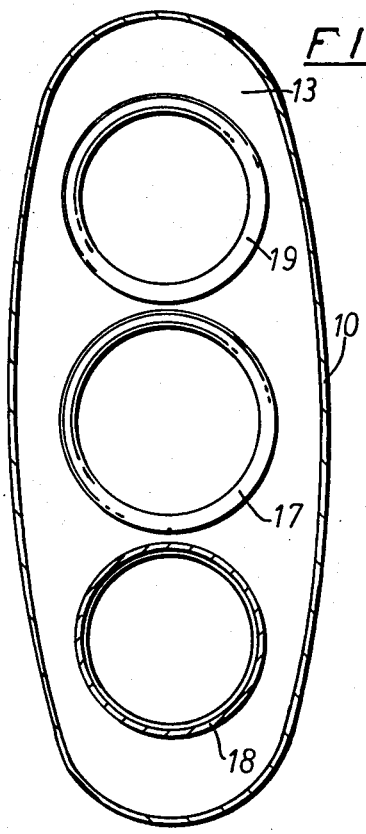
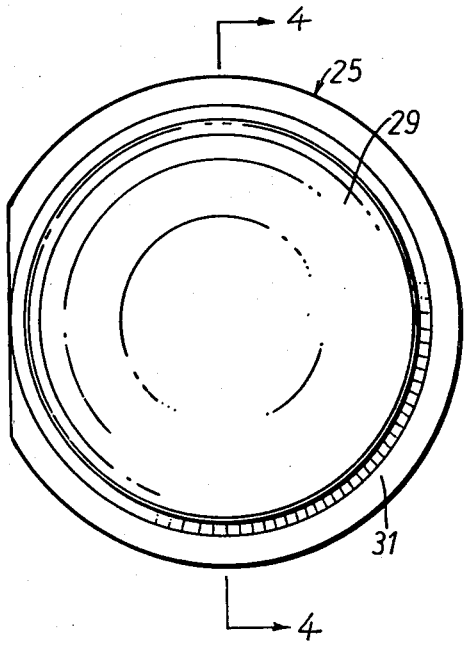
FIG.3
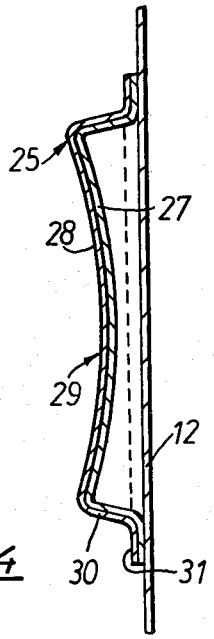
FIG.4

EXHAUST MUFFLERS FOR INTERNAL COMBUSTION ENGINES

BACKGROUND OF THE INVENTION

The invention relates to exhaust mufflers for internal combustion engines of the kind comprising a closed chamber having an inlet pipe and an outlet pipe and containing means for absorbing noise in exhaust gases flowing into the chamber through the inlet pipe before the gases pass from the chamber through the outlet pipe.

As is well known, in mufflers of this type any improvement in the noise reducing properties of the muffler is usually accompanied by a reduction in the rate of flow of exhaust gases through the muffler, this reduction in rate of flow causing loss of power and efficiency of the engine and increase in fuel consumption.

International exhaust noise regulations are currently placing increasingly stringent limits on the noise output of motor vehicle exhausts, while at the same time there is an increasing demand for fuel economy. For the reason mentioned above, these requirements are to a certain extent conflicting and it is therefore an object of the invention to provide an exhaust muffler which effectively limits the noise output from the engine while at the same time maintaining a high flow rate of exhaust gases through the muffler.

Although it is desirable for the noise output from an engine exhaust to be kept low, there is also a requirement, particularly where the muffler is for use with engines in high performance vehicles, that the exhaust note which is produced should have a deep, powerful sound. It is therefore a further object of the invention to provide a muffler which may be constructed with a bias towards reducing noise in the high and midrange frequencies.

SUMMARY OF THE INVENTION

According to the invention there is provided an exhaust muffler comprising a closed chamber, an inlet pipe leading into the chamber, an outlet pipe leading from the chamber, at least one pipe length, having an open end, within the chamber, and means for reducing noise in exhaust gases flowing into the chamber through the inlet pipe before the gases pass from the chamber through the outlet pipe, said noise-reducing means including at least one noise reflector located opposite and spaced from the open end of said pipe length within the chamber in such manner as to reflect down the pipe length a proportion of the noise generated by gases flowing along the pipe length.

Said pipe length may comprise a continuation, within the chamber, of said inlet pipe or of said outlet pipe.

The noise reflector is preferably a parabolic reflector located on the central axis of said pipe length. The noise reflector may comprise two layers of material of different natural frequencies in frictional engagement with one another, so that vibrations induced in each layer tend to be damped by frictional engagement with the other layer. The layers may be of similar cross-sectional shape and nested one within the other. The noise reflector may be mounted on a bulkhead extending across the closed chamber, such as an end wall of the chamber.

The open end of said pipe length within the chamber is preferably outwardly flared to improve the rate of gas flow into or out of the pipe length.

In a preferred embodiment the muffler comprises a closed chamber, an inlet pipe leading into the chamber, an outlet pipe leading from the chamber, two spaced bulkheads dividing the chamber into first and second buffer compartments separated by an intermediate compartment, at least three pass tubes extending through the bulkheads and across the intermediate compartment, two of the pass tubes forming continuations of the inlet and outlet pipes respectively and having open ends in the buffer compartments respectively, the aforesaid noise reflector being located opposite the open end of at least one of the pass tubes in such manner as to reflect down the pass tube a proportion of the noise generated by gases flowing along the pass tube.

The pass tube forming a continuation of the inlet pipe is preferably of the same diameter as the inlet pipe, and the pass tube forming a continuation of the outlet pipe is preferably of the same diameter as the outlet pipe.

The intermediate compartment is preferably filled with a body of gas permeable material, such as glass fibre, at least one of the pass tubes having perforated walls whereby gases flowing along the pass tube may escape through the perforations into the gas permeable material.

Where two of the pass tubes have open ends in the same buffer compartment, they preferably have portions of different lengths projecting into that buffer compartment, whereby the open ends of the pass tubes lie in different planes. This reduces the extent to which gases flowing out of one tube and into the other must pass closely while moving at high speed in opposite directions.

BRIEF DESCRIPTION OF THE DRAWINGS

FIG. 2 is a cross-section on the line 2—2 of FIG. 1, FIG. 3 is a front view of one of the noise reflectors employed in the muffler of FIGS. 1 and 2, and FIG. 4 is a section through the reflector along the line 4—4 of FIG. 3.

DETAILED DESCRIPTION OF THE PREFERRED EMBODIMENT

Figure 1:
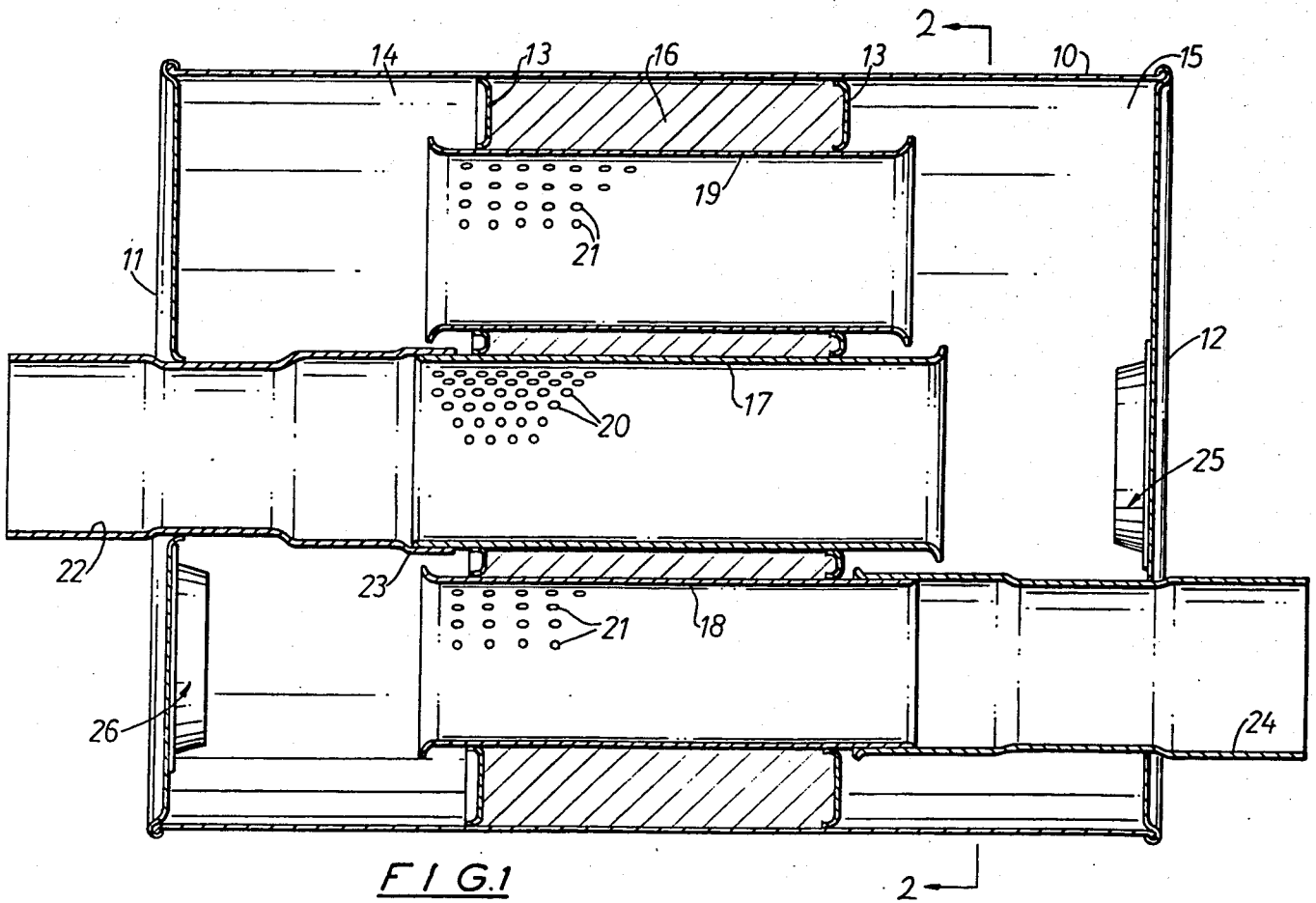
FIG. 1 is a longitudinal section through an exhaust muffler according to the invention.

Referring to FIGS. 1 and 2, the muffler comprises a main casing 10 formed from welded sheet metal. The casing, as seen in FIG. 2, is in the form of an elongate oval in cross-section and is closed by end plates 11, 12 at opposite ends of the casing.

The chamber within the casing 10 is divided by two parallel spaced bulkheads 13 into first and second buffer compartments 14 and 15 separated by an intermediate compartment 16 between the two bulkheads.

Three pass tubes 17, 18 and 19 extend through the bulkheads 13 and across the intermediate chamber 16. The wall of the centre pass tube 17 is formed with a high density array of perforations as indicated at 20, and low density arrays of perforations, as indicated at 21, are formed in the walls of the pass tubes 18 and 19. The intermediate chamber between the bulkheads 13 and around the pass tubes 17, 18 and 19 is filled with glass fibre packing.

The centre pass tube 17 forms a continuation of an inlet pipe 22 which extends through the end plate 11 of the casing. The major part of the inlet pipe 22 is of the same internal diameter as the centre pass tube 17 and the end of the inlet pipe 22 within the chamber 14 is swaged to a larger diameter so as tightly to embrace the projecting end of the pass tube 17 as indicated at 23.

The pass tube 18 forms a continuation of an outlet pipe 24 which pass through the end plate 12 and tightly embraces the end of the pass tube 18 which projects into the buffer compartment 15.

The open ends of the pass tubes 17, 18 and 19, within the buffer compartments, are flared outwardly as shown in FIG. 1. The centre pass tube 17 projects into the buffer compartment 15 to a greater extent than the pass tube 19 so that the open ends of the tubes 17 and 19 within the buffer compartment 15 lie in different planes.

A parabolic noise reflector 25 is mounted on the end plate 12 on the central axis of the pass tube 17 and faces, and is spaced from, the flared end of the pass tube. A similar parabolic reflector 26 is mounted on the end plate 11 opposite the flared end of the pass tube 18.

The two parabolic reflectors are of similar construction, and the reflector 25 is shown in greater detail in FIGS. 3 and 4. The reflector is generally circular and is formed from two similar nested layers 27 and 28. The nested layers are formed by pressing the reflector in a press tool from two sheets of steel together. Each layer comprises a central concave portion 29, a peripheral wall 30 and a radial outer flange 31. The outer flanges 31 of the two layers are spot-welded to the end plate of the muffler by at least four spot welds evenly distributed around the circumference of the reflector. The two layers of each reflector are secured together by the spot welds but are otherwise unconnected. As best seen in FIG. 3 a segment is removed from the flanges 31 at one side of the reflector so that the reflector clears the adjacent inlet or outlet pipe.

The central concave portion 29 of the reflector should preferably be parabolic to give the best results, but good results may also be achieved where the concave portion is part-spherical.

In operation of the muffler exhaust gases from the internal combustion engine pass into the muffler through the inlet pipe 22. As previously mentioned, the inlet pipe 22 is of generally the same internal diameter as the pass tube 17. In known mufflers it is conventional practice for the inlet pipe to be of greater internal diameter than the pipe which forms its continuation within the muffler and, as a result, there is an interference with the flow of exhaust gases into the muffler due to the edge effect of the junction between the inlet pipe and the pipe forming its continuation. By swaging out the inlet pipe to fit over a pass tube of the same diameter, this edge effect is eliminated and improved flow characteristics are achieved.

As the exhaust gases flow through the centre pass tube 17 the gases pass through the perforations 20 into the glass fibre pack within the intermediate compartment 16 where sound absorption takes place in known manner.

The glass fibre is a special toughened, high temperature glass which is resistant to heat far above normal muffler temperatures and is less prone to thermal shocks than ordinary glass. As sound pulses pass into the glass pack, they cause the glass to vibrate and this has the effect of turning the noise energy into heat energy which is then dissipated through the casing of the muffler. The selection of the type of glass is important as it determines the frequency spectrum in which the best sound absorption takes place. The glass is tuned to the absorption of the higher frequencies in the sound spectrum.

The high amplitude mid and lower frequency noise spectrum is reduced by virtue of gas friction through the strands of glass. Gases pass into the glass pack through the high density perforations of the centre pass tube 17 and the pulsations of flow are damped by the backward and forward motion of the mass of gas in the glass pack itself. It the pack is too densely packed, the slug of gas will tend to pass right through the pass tube without interacting with the glass pack in the intermediate compartment 16. If the pack is too lightly packed, insufficient damping will take place and the muffler will produce a more metallic ringing noise tone which is not generally accepted as a pleasant exhaust note.

As the exhaust gases emerge from the centre pass tube 17 into the buffer compartment 15, they impinge upon the parabolic reflector 25 mounted on the end plate 12. The purpose of the parabolic reflector 25 is to provide some measure of noise damping by reflecting a proportion of the high energy noise back down the pass tube 17 so that at some point a positive wave travelling down the pass tube or inlet tube will tend to cancel out a negative wave travelling in the opposite direction. A secondary function of the noise reflector 25 is to render the end plate 21 acoustically dead. As previously described, the reflector is pressed out of two sheets of material in one pass. This means that the natural vibration frequency of the two layers is different, in view of their slight difference in dimensions, and since they are in contact with each other any vibrations which tend to excite them will be damped out by friction between the two layers. The noise reflectors will also pick up vibrations from the end plates 12 and 11 and damp them out in similar fashion.

Gases pass through the pass tube 17 into the buffer compartment 15 then travel in the reverse direction along the pass tube 19 to the buffer compartment 14. The best flow properties in any system which have to pass gas are achieved when some uniform flow pattern can be established. One of the greatest losses in flow capability occurs when high speed gases pass each other closely, going in opposite directions, since this can cause disorientation of the flow. The arrangement shown in the drawings whereby the pass tube 17 projects into the buffer compartment 15 to a greater extent than the pass tube 19 minimises this effect by reducing the extent to which the gases pass each other closely while travelling in opposite directions within the buffer compartment.

I claim:

1. An exhaust muffler comprising a closed chamber, an inlet pipe leading into the chamber, an outlet pipe leading from the chamber, at least one pipe length, having an open end, within the chamber, and means for reducing noise in exhaust gases flowing into the chamber through the inlet pipe before the gases pass from the chamber through the outlet pipe, said noise-reducing means including at least one noise reflector located opposite and spaced from the open end of said pipe length within the chamber in such manner as to reflect down the pipe length a proportion of the noise carried by gases flowing along the pipe length, said noise reflector comprising two layers of material of different natural frequencies in frictional engagement with one another.

2. An exhaust muffler according to claim 1, wherein said layers are of similar cross-sectional shape and are nested one within the other.

3. An exhaust muffler according to claim 2, wherein each layer is parabolic in cross-section and is located on the central longitudinal axis of the pipe length.

4. An exhaust muffler comprising a closed chamber, an inlet pipe leading into the chamber, an outlet pipe leading from the chamber, two spaced bulkheads dividing the chamber into first and second buffer compartments separated by an intermediate compartment, at least three pass tubes extending through the bulkheads and across the intermediate compartment, two of the pass tubes forming continuations of the inlet and outlet pipes respectively and having open ends in the buffer compartments respectively, and a noise reflector located opposite the open end of at least one of the pass tubes in such manner as to reflect down the pass tube a proportion of the noise carried by gases flowing along the pass tube, said reflector comprising two layers of different natural frequencies in frictional engagement with one another.

5. An exhaust muffler according to claim 4, wherein said layers are of similar cross-sectional shape and are nested one within the other.

6. An exhaust muffler according to claim 5 wherein each layer is parabolic in cross-section and is located on the central longitudinal axis of the pass tube.

7. An exhaust muffler comprising a closed chamber, an inlet pipe leading into the chamber, an outlet pipe leading from the chamber, two spaced bulkheads dividing the chamber into first and second buffer compartments separated by an intermediate compartment, at least three pass tubes extending through the bulkheads and across the intermediate compartment, two of the pass tubes forming continuations of the inlet and outlet pipes respectively and having open ends in the buffer compartments respectively, and a circular noise reflector located opposite the open end of at least one of the pass tubes, the noise reflector being co-axial with the pass tube and so shaped as to reflect down the pass tube a proportion of the noise carried by gases flowing along the pass tube.

* * * * *